US009670662B2

(12) United States Patent
Newhoff

(10) Patent No.: US 9,670,662 B2
(45) Date of Patent: Jun. 6, 2017

(54) MARKER WITH TWISTED REFLECTIVE STRIP

(71) Applicant: Timothy G. Newhoff, Sonora, CA (US)

(72) Inventor: Timothy G. Newhoff, Sonora, CA (US)

( * ) Notice: Subject to any disclaimer, the term of this patent is extended or adjusted under 35 U.S.C. 154(b) by 160 days.

(21) Appl. No.: 14/788,162

(22) Filed: Jun. 30, 2015

(65) Prior Publication Data

US 2017/0002560 A1 Jan. 5, 2017

(51) Int. Cl.
*E04B 1/62* (2006.01)
*E04B 1/38* (2006.01)
*E04F 21/00* (2006.01)

(52) U.S. Cl.
CPC ..... *E04B 1/62* (2013.01); *E04B 1/38* (2013.01); *E04F 21/00* (2013.01)

(58) Field of Classification Search
CPC . E04B 1/38; E04B 1/62; E04B 1/7616; E04B 2001/741; E04F 21/00; E04F 21/04; E04F 21/06; E04F 21/08
USPC ..... 116/200, 209; 52/103, 105
See application file for complete search history.

(56) References Cited

U.S. PATENT DOCUMENTS 3,009,437 A * 11/1961 Hollinger et al. ..... E04H 12/20 116/209
4,423,554 A * 1/1984 Cantrell ..... G01B 5/18 33/458
5,247,900 A * 9/1993 Sobczak ..... G09F 17/00 116/173
6,085,452 A * 7/2000 Davis ..... G01C 15/06 116/209
6,575,115 B2 * 6/2003 Lake ..... G01B 5/066 116/200
6,964,115 B2 * 11/2005 Kim ..... E04G 21/10 116/227
8,136,471 B1 * 3/2012 Carrette ..... G09F 17/00 116/173
2010/0107963 A1 * 5/2010 Black ..... G09F 23/00 116/209

FOREIGN PATENT DOCUMENTS

DE 2712427 A1 * 10/1977 ..... E04B 1/4185
DE 29710253 U1 * 8/1997 ..... E01F 9/627
DE 102011077657 A1 * 12/2012 ..... E04B 1/2612
FR 2264716 A1 * 10/1975 ..... B64F 1/20
RU 2163742 C2 * 2/2001 ..... H01Q 15/18

* cited by examiner

*Primary Examiner* — R. A. Smith
(74) *Attorney, Agent, or Firm* — David T. Millers

(57) ABSTRACT

A marker has an anchor portion and a twisted portion, and the twisted portion has one or more reflective sides and is twisted about a length axis of the strip so that part of at least one of the reflective sides faces any view toward the marker. Or, a marker includes an anchor portion and a reflective portion, and the reflective portion contains a material that permits manual, plastic deformation to create a twist in the reflective portion. The marker when twisted may be attached to mark a location of a feature of a building in which insulation hides the feature but leaves the twisted portion of the marker exposed within an access space of the building.

19 Claims, 3 Drawing Sheets

MARKER WITH TWISTED REFLECTIVE STRIP

BACKGROUND

Thermal insulation in attics, walls, and other portions of buildings often cover or otherwise hide build features. For example, attic insulation often completely covers wooden or metal structural members, electrical wiring, junction boxes, pipes, valves, and other building features. Similarly, insulation attached to walls or under floors may also hide building features. Accordingly, insulation often makes locating building features more difficult when repairs or alterations of the building are attempted.

SUMMARY

In accordance with an aspect of the invention, a marker, flag, or stake with a twisted reflective surface may mark the location of a building feature that may be hidden by insulation. For example, a marker may attach to a building near a building feature and extend through insulation into a worker accessible space where the twisted reflective surface may be seen. Alternatively, a marker may be implanted in or attached to insulation to mark a location of a feature hidden by the insulation. The twist of the portion of the marker in the accessible space can make part of the reflective surface visible from every angle around the marker.

One specific implementation is a marker that includes a strip of deformable material that is reflective on one or both major surface and may be twisted so that portions of the reflective surface(s) respectively face every direction around the marker. The marker may, for example, include an aluminum or other metal strip and having reflective tape on one or both sides. The marker may be twisted when sold. Alternatively, the marker may be flat when sold and a user may twist the marker for use. An anchor portion of the marker or strip may have an attachment feature such as a screw hole or an adhesive pad or may be pointed or otherwise sized and shaped for implanting into a material such as insulation.

Another specific implementation is a process that includes locating a building feature that is hidden by insulation and attaching a marker so that a twisted and reflective portion of the marker extends above the insulation and thereby marks the location of the building feature. In a dark access space such as an attic or under-building crawl space, a worker with a flashlight can readily identify the location of the marker from light reflected from the marker and therefore identify the hidden building feature.

BRIEF DESCRIPTION OF THE DRAWINGS

The drawings illustrate examples for the purpose of explanation and are not of the invention itself. Use of the same reference symbols in different figures indicates similar or identical items.

DETAILED DESCRIPTION

A twisted reflective marker may be used to mark the location of a building feature such as a hidden electrical connection, communication lines, water or gas pipes, valves, or structural members. In an example use, a building feature may be hidden by insulation so that the building feature cannot be directly seen from an access space. A twisted reflective marker can be attached to the building, e.g., screwed to a structural member or implanted in or attached to the insulation, so that a twisted reflective portion of the marker extends beyond the insulation and indicates the location of the hidden building feature. The reflective portion may be twisted such that the marker strongly reflects light that may be incident on the marker from any direction. Accordingly, even in a dark access space such as an attic or a crawl space, a worker can easily identify the location of the marker and therefore the location of the marked building feature.

One implementation of a marker uses inexpensive materials such as an aluminum strip with an anchor portion and a twisted or twistable portion to which a reflective tape or coating attaches. The aluminum strip that be twisted before or after sale of the marker.

Figure 1A:
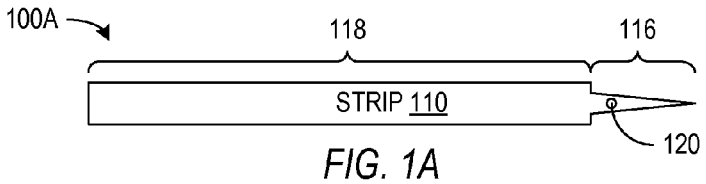
FIG. 1A shows a plan view of an implementation of a twistable reflective marker with a pointed anchor portion.

FIG. 1A shows a plan view of a twistable reflective flag, stake, or marker 100A. Marker 100A may be a thin strip 110 shaped to form an anchor portion 116 and a twistable portion 118. Strip 110, and particularly twistable portion 118, may made of a material capable of plastic deformation under forces that a user may apply by hand. For example, aluminum about 0.04 inches or less thick can be manually twisted and can undergo plastic deformation to retain a twisted shape as described further below. Marker 100A can generally have any size, but for uses in a typical building space, twistable portion 118 may be less than about 0.2 inches thick, about 0.5 to 1.0 inches wide and about 6 to 24 inches long. In general, the length or marker 100A may be chosen according to the depth or thickness of the insulation in which the marker will be used. The width may be chosen for visibility, and the thickness may be chose for the ability to be manually deformed and to support or retain a deformation under its own weight.

Anchor portion 116 does not need to be deformable but may be made of the same material as twistable portion 100 in order to simplify manufacture. In the implementation shown in FIG. 1A, strip 110 is cut, punched, or otherwise formed to have a pointed end as anchor portion 116. The pointed end may be stuck into insulation, wood, or other material in the same manner as a stake or nail. The size and shape of the pointed end may generally be selected for ease of use, e.g., for implanting in insulation, and for preventing maker 100A from falling over after insertion into insulation. In general, for visibility, the length axis twistable portion 118 of marker 100A may be kept roughly perpendicular to the surface of insulation, e.g., marker 100A may be kept vertical when marker 100A is extends into or through attic installation. Additionally, anchor portion 116 may further include an attachment feature 120 such as a screw hole, an adhesive pad, double sided tape, or any structure that facilitates attaching marker 100A to a building, e.g., to a building feature, a structural member of the building, or insulation lining. In one implementation, anchor portion 116 may employ double sided tape or other adhesive that may attach marker 100A to a solid surface, and in addition to being twisted, reflective portion 118 may be bent to provide any desired orientation of reflective portion 118. For example, if adhesive attaches anchor portion 116 to a horizontal surface in an attic, reflective portion 118 may be bent up by 90°, to vertical. In one use, marker 100A may be glued or otherwise attached to a building feature in an attic before blowing in loose insulation and may visibly extend above the insulation after installation of the insulation is complete.

Figure 1B:
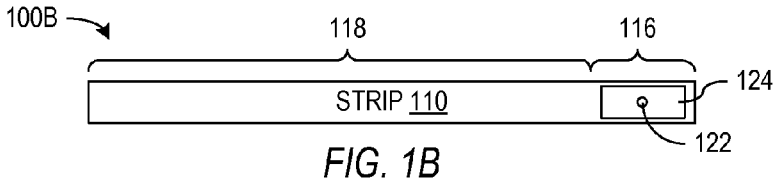
FIG. 1B shows a plan view of an implementation of a twistable reflective marker with a blunt anchor portion.

FIG. 1B shows a marker 100B which may be identical to marker 100A except that anchor portion 116 of marker 100B is blunt rather than being pointed. FIG. 1B also illustrates that anchor portion 116 may include multiple attachment features such as a screw hole 122 and an adhesive pad or double-sided tape 124. Attachment of marker 100B may use one or both attachment features 122 and 124.

Figure 1C:
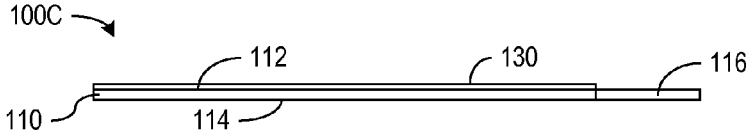
FIG. 1C shows a side view of an implementation of a twistable reflective marker having reflective tape on one major surface.

FIG. 1C shows a side view of one implementation of a twistable marker 100C, which may be identical to marker 100A or 100B. FIG. 1C particularly shows how a strip 110 has two major surfaces 112 and 114 and how a reflective layer 130 may be applied one major surface 112 of strip 110 to make one side of marker 100B more reflective. In one implementation, layer 130 includes reflective tape adhered to surface 112 of twistable portion 118. Many types of reflective tape including but not limited to silvered or mirror tape, fluorescent tape, and tape having attached or embedded optical features or elements such as retroreflectors could be used. As an alternative to tape, reflective layer may be a coating such as a paint dipped, sprayed, or otherwise applied to surface 112 of strip 110. A coating may include particulates such as glass beads to improve reflectivity. As an alternative to reflective layer 130, surface 112 of strip 110 may inherently be reflected or may be made reflective through polishing, patterning, or other surface treatment.

Figure 1D:
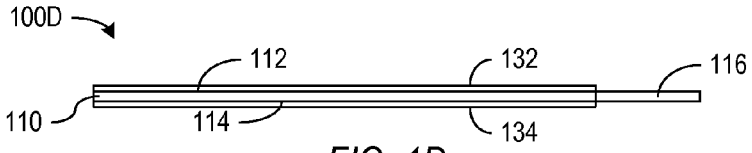
FIG. 1D shows a side view of an implementation of a twistable reflective marker having reflective tape on both major surfaces.

FIG. 1D shows a side view of another implementation of a twistable marker 100D, which may be identical to marker 100A or 100B and may be an alternative to marker 100C. Marker 100D has reflective layers 132 and 134 respectively on opposite major surfaces 112 and 114 of strip 110. Each of layers 132 and 134 may be identical to layer 130 as described above. In particular, each layer 132 or 134 may be reflective tape or a coating applied to surface 112 or 114. Layers 132 and 134 may be substantially identical to each other or may be different from each other. In particular, layers 132 and 134 may have different colors or may be of different types, which may be used for color coding or to improve visibility of marker 100C, e.g., if layers 132 and 134 have peak visibility in different lighting conditions.

FIG. 2 shows an implementation of a twisted marker 200A. Marker 200A may be the same as any of markers 100A, 100B, 100C, or 100D described above, except that portion 118 of marker 100 is twisted about an axis 250 running along the length of marker 200A. In one example, the twisted portion of marker 200A is a helicoid, and each edge of the twisted portion follows a helix. In general, a mathematically defined shape is not required for the twist. In the illustrated embodiment, the twist of marker 200A is one half of a rotation or 180°, so that a view of marker 200A from any angle around marker 200A show portions of both major surfaces 112 and 114 of strip 110 or of any reflective layer 130, 132, or 134 that may be on surface 112 or 114. More generally, the twist angle of marker 200A may be any non-zero angle sufficient to show a reflective surface of marker 200A from any view toward marker 200A when marker 200A is in use. For example, if only one surface 112 or 114 is reflective, e.g., is polished or has an added reflective layer, and if the entire twisted portion is above insulation, the twist may be about 180° or more around length axis 250. Alternatively, if both surfaces 112 and 114 of marker 100 are reflective, the twist be about 90° of more, e.g., so that at least one of surfaces 112 and 114 directly faces and is visible from any view toward length axis 250 when the twisted portion is above insulation.

Figure 2A:
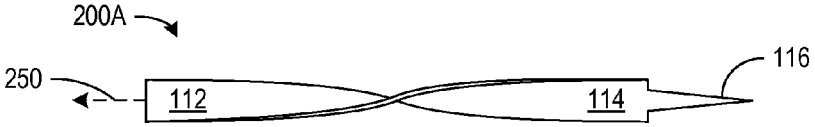
FIG. 2A shows an implementation of a twisted reflective marker.
Figure 2B:
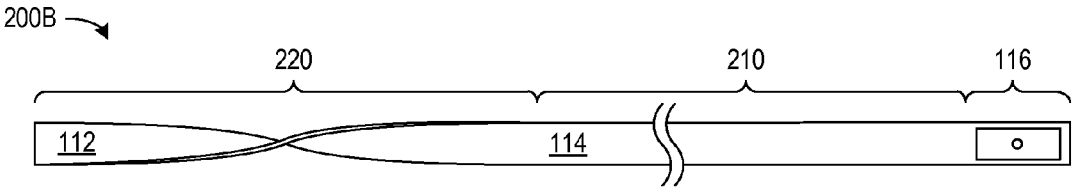
FIG. 2B shows an implementation of a twisted reflective marker having flat and twisted portions.

A portion of a maker that may be within insulation and not visible. The portion of a marker within insulation may be twisted or not twisted. FIG. 2B shows a flag 200B having an anchor portion 116, a twisted portion 220, and an intervening portion 210. Intervening portion 210 may have a length selected according to the thickness of insulation in which marker 200B will be employed. For example, if marker 200B is intended to extend through insulation up to 18 inches thick, intervening portion 210 may be about 18 inches long or the length otherwise required so that in use, twisted portion 220 extends beyond the insulation and into an access space. Intervening portion 210 may be twisted or not twisted and may or may not have a reflective surface because if twisted portion 220 is visible, the visibility of marker 200B does not depend on intervening portion 210 being seen.

Marker 200A or 200B may be made by twisting twistable portion 118 of marker 100A, 100B, 100C, or 100D so that a portion of the twistable marker deforms and retains the twist either along the entire length of portion 118 or part of the length of portion 118. Such twisting of a marker can be completed during manufacture of marker 100. Alternatively, a twistable marker 100A, 100B, 100C, or 100D may be flat as shown in FIGS. 1A, 1B, 1C, or 1D when sold to a user, and the user may twist a portion of marker 100A, 100B, 100C, or 100D to create a twisted marker 200A or 200B as shown in FIG. 2A or 2B. In particular, a user may manually twist the twistable portion 118 of marker 100A, 100B, 100C, or 100D to plastically deform the twistable portion and create the shape shown in FIG. 2A or 2B. Alternatively, markers 200A and 200B of FIGS. 2A and 2B do not need a deformable or twistable portion but can be manufactured and sold with a rigid reflective portion having a twisted shape such as shown in FIGS. 2A and 2B.

Figure 3:
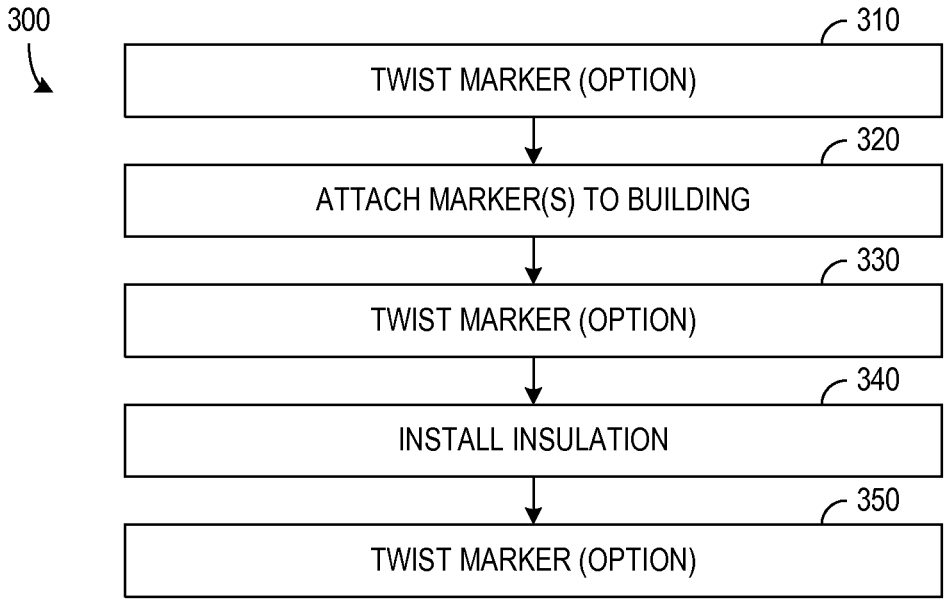
FIG. 3 is a flow diagram of a process that attaches a twisted marker to a building to mark building features that insulation hides.

FIG. 3 is a flow diagram of a process 300 for using a twisted marker to mark the locations of building features. In process 300, a process block 320 illustrates attaching one or more twisted or twistable markers such as the markers described above to a building. Process block 320 may, for example, include gluing, screwing, bolting, or otherwise affixing the anchor portions of markers to the building. The markers may directly attach to the features being marked or may attach to the building in locations that are related to the locations of the marked building features. For example, the markers may be attached next to, above, or at a know distance from the building features marked.

Process block 340 represents installation of insulation, which may be performed after one or more markers are attached in process block 320. For example, process block 340 may include blowing loose insulation to provide a desired thickness of thermal installation. Alternatively, lined insulation may be installed with markers extending through the lined insulation. The length of the attached markers may be preselected so that a twisted portion of the marker extends beyond the surface of the insulation and is thus visible from within the access space adjacent to the insulation.

Process 300 also illustrates three alternative options for twisting of the attached markers. In option 310, the markers have twists before being attached to the building in process block 320. For example, the markers may have been manufactured and sold with a twist or may be twisted by a user when attaching the markers. In option 330, a user twists the markers after the markers have been attached to the building but before process block 340 installs insulation. In option 350, the user twists markers after the insulation is install, which may simplify providing the desired number of turns in the portion of the marker that is reflective and above the surface of the insulation.

Figure 4:
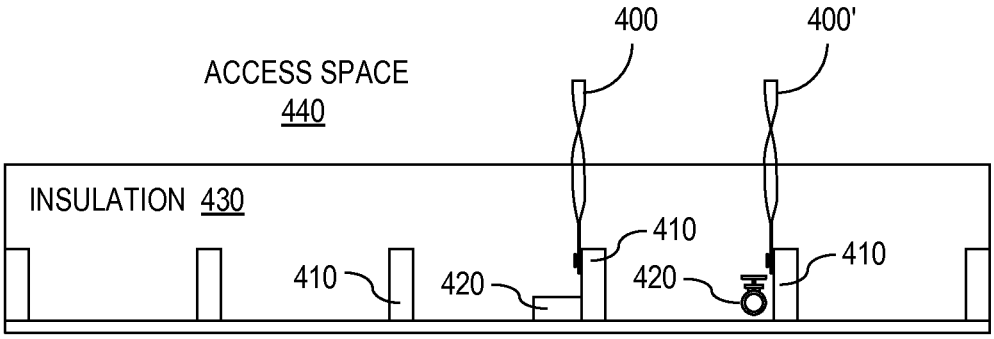
FIG. 4 shows a cross-sectional view of an access space of a building in which twisted reflective markers are attached to the building to mark locations of building features.

FIG. 4 illustrates use of twisted markers 400 and 400' in a building access space 440. Building access space 440 may be, for example, an attic or a crawl space. Access space 440 may provide access to wood or metal structural members 410 and other building features 420. Insulation 430, which may be thermal insulation used to improve energy efficiency of heating or cooling of the building, covers and hides building features 410 and 420, so that insulation 430 blocks sight from access space 440 to features 410 and 420. To mark the location of a particular feature 420, marker 400 affixed to the building feature 420 or to another building feature 410 have some know relationship to the marked building feature 420. In FIG. 4, marker 400 is screwed or nailed to a beam 410 adjacent to a marked electrical junction box 420, and marker 400' is screwed or nailed to a beam 410 adjacent to a marked water or gas valve 420. A worker in access space 440 can then see markers 400 and 400' and identify the locations of the marked features 420. Further, since from any angle around the visible portion of marker 400, reflective portions of twisted markers 400 and 400' can be seen, the locations of marker 400 and 400' can be readily identified with a relatively weak light such as a flash light when access space 440 is dark.

Figure 5:
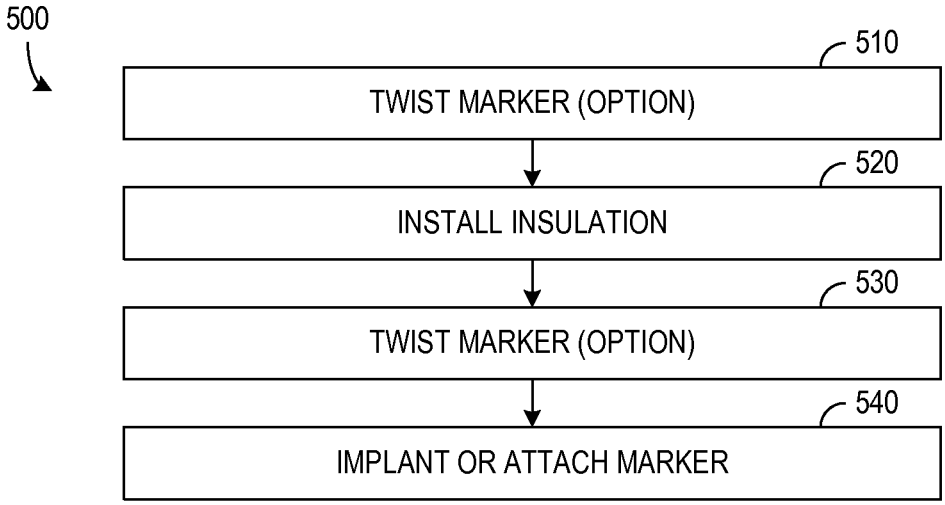
FIG. 5 is a flow diagram of a process in which a twisted marker is implanted in or attached to insulation to mark building features that insulation hides.

FIG. 5 is a flow diagram of another process 500 for using a twisted or twistable marker to mark the locations of building features. In process 500, a process block 520 represents installation of insulation, and a process block 540 illustrates implanting or attaching one or more twisted or twistable markers to or in the insulation. For example, markers may be implanted like stakes in the insulation. Alternatively, marks may be glued or otherwise affixed to the liners of the installed insulation.

Process 500 also illustrates two options for twisting of the attached markers. In option 510, the markers are twisted before process block 520 installs the insulation. For example, the markers may have been twisted at the factory or may be twisted by a user before use. In option 530, a user twists the markers after the insulation is installed and before process block 540 implants the marker in the insulation.

Figure 6:
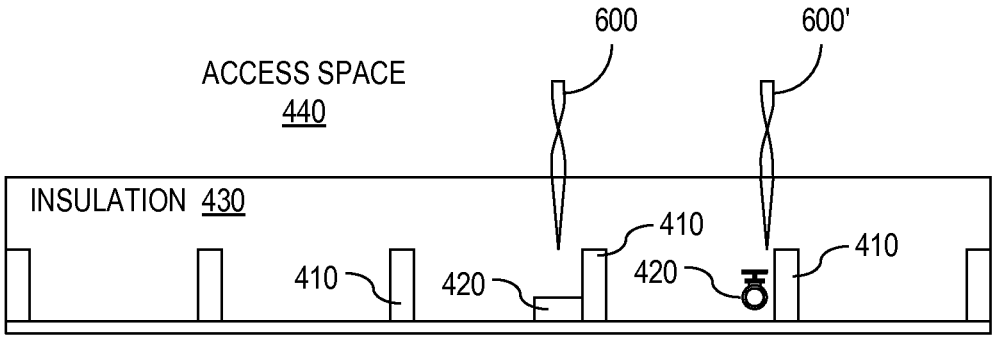
FIG. 6 shows a cross-section view of an access space of a building in which twisted reflective markers implanted in insulation mark locations of building features.

FIG. 6 illustrates use of twisted markers 600 and 600' in a building access space 440. The use of markers 600 and 600' may be the same as use of markers 400 and 400' of FIG. 4, except that markers 600 and 600' are implanted in the installed insulation.

Many applications may need to employ multiple markers in an access space. For example, FIGS. 4 and 6 show situations where one marker 400 or 600 marks the location of an electrical junction box and another marker 400' or 600' marks the location of a valve. In such applications, markers 100 and 100' may be differentiated using a color code in which markers 100 and 100' have different colors, e.g., different colors of reflective tape on one or both sides, to distinguish the building features marked.

Although particular implementations have been disclosed, these implementations are only examples and should not be taken as limitations. Various adaptations and combinations of features of the implementations disclosed are within the scope of the following claims.

What is claimed is:

1. A marker comprising:

an anchor portion; and a strip having one or more reflective sides, the strip having a twisted portion that is twisted about a length axis of the strip so that part of at least one of the reflective sides faces any view toward the marker.

2. The marker of claim 1, wherein the anchor portion is pointed for insertion into insulation and sized to keep a length of the twisted portion perpendicular to a surface of the insulation.

3. The marker of claim 1, wherein the strip comprises an aluminum strip shaped to form the anchor portion and the twisted portion.

4. The marker of claim 1, further comprising a first reflective layer on the twisted portion, wherein the twisted portion is twisted about the length axis such that part of the first reflective layer faces any view toward the marker.

5. The marker of claim 4, wherein the first reflective layer comprises reflective tape.

6. The marker of claim 4, wherein the twisted portion is twisted by about 180° or more.

7. The marker of claim 1, further comprising a first reflective layer and a second reflective layer on opposite major surfaces of the twisted portion, wherein the twisted portion is twisted so that a part of at least one of the first reflective layer and the second reflective layer faces any view around the twisted portion.

8. The marker of claim 7, wherein the twisted portion is twisted by about 90° or more.

9. A marker comprising:

an anchor portion configured to attach to a building; and a strip with a reflective portion, the strip being made of a material that permits manual, plastic deformation of the reflective portion to create a twist in the reflective portion about a length axis of the strip.

10. The marker of claim 9, wherein the strip comprises an aluminum strip that permits the manual plastic deformation.

11. The marker of claim 10, the reflective portion comprises a first reflective layer on a first major surface of the strip.

12. The marker of claim 11, the reflective portion comprises a second reflective layer on a second major surface of the strip.

13. A process comprising:

attaching a marker to mark a location of a feature of a building, the marker having a twisted portion with one or more reflective surfaces, the twisted portion being is twisted about a length axis of the marker; and installing insulation in the building, wherein the insulation hides the feature but leaves the twisted portion of the marker exposed within an access space of the building.

14. The process of claim 13, wherein attaching the marker comprises affixing an anchor portion of the marker to one of the feature and a structural member near the feature.

15. The process of claim 14, wherein the installing the insulation is completed after the attaching of the marker.

16. The process of claim 13, wherein the attaching of the marker is performed after the installing of the insulation.

17. The process of claim 16, wherein attaching the marker comprises attaching an anchor portion of the marker to the insulation.

18. The process of claim 17, wherein the attaching of the anchor portion comprises implanting the anchor portion into the to the insulation.

19. The process of claim 13, further comprising manually twisting the marker to plastically deform the marker and create the twisted portion.

* * * * *